US006230418B1

(12) United States Patent
Gomulinski

(10) Patent No.: US 6,230,418 B1
(45) Date of Patent: May 15, 2001

(54) LOW PROFILE DRYER EXHAUST VENT SYSTEM

(76) Inventor: Dennis R. Gomulinski, 30436 Gloede, Warren, MI (US) 48093

( * ) Notice: Subject to any disclaimer, the term of this patent is extended or adjusted under 35 U.S.C. 154(b) by 0 days.

(21) Appl. No.: 09/558,196

(22) Filed: Apr. 26, 2000

(51) Int. Cl.[7] ..... D06F 58/00

(52) U.S. Cl. ..... 34/140; 34/235; 454/359; 454/903; 285/168; 285/181; 285/183; 285/278

(58) Field of Search ..... 454/359, 903; 285/168, 169, 181, 183, 278, 203; 34/235, 79, 140

(56) References Cited

U.S. PATENT DOCUMENTS

D. 411,901 7/1999 Gomulinski .
2,823,703 * 2/1958 Nusser, Jr. ..... 138/52
4,081,915 * 4/1978 Babcerowicz et al. ..... 34/235
4,152,844 * 5/1979 Babcerowicz et al. ..... 34/235
4,434,564 * 3/1984 Braggins, Jr. ..... 34/86
5,121,948 * 6/1992 Anderson et al. ..... 285/168
5,185,941 * 2/1993 Dongelmans ..... 34/242
5,915,735 * 6/1999 Noble ..... 285/4
6,101,741 * 8/2000 Sears ..... 34/417

* cited by examiner

*Primary Examiner*—Pamela Wilson
(74) *Attorney, Agent, or Firm*—Chupa & Alberti, P.C.

(57) ABSTRACT

System for installation of a complete, safe, compact, and efficient dryer exhaust. Provides access to internal areas of conduit for dryer lint build-up removal.

Allows dryer placement in tight confines: laundry closets, pantry areas, first floor apartments. System may be used to route dryer exhaust conduit inside of dwelling walls.

5 Claims, 4 Drawing Sheets

LOW PROFILE DRYER EXHAUST VENT SYSTEM

FIELD OF INVENTION

The present invention relates to an exhaust vent system. More specifically, to a low profile, cleanable exhaust venting system for clothes dryers.

BACKGROUND OF THE INVENTION

By their design function, dryer exhaust conduits conduct substantial quantities of heated exhaust air from the dryer to an outside vent. The heated air contains significant amounts of water vapor and lint. In the case of natural gas fired dryers, carbon monoxide and other harmful combustion gases are routed out through the vent system as well.

The nature of the exhaust air in conjunction with the typical dryer vent installation can cause problems. Manufactures generally recommend that dryer installations be completed with metal or other rigid fixed conduit. This is an attempt to steer consumers away from the use of ribbed, flexible vinyl or foil tubing. While the familiar ribbed vinyl or foil tubing serves the intended purpose and has become the mainstay installation of "do-it-yourselfers" and discount appliance or other low cost appliance providers, it has drawbacks and dangers. These drawbacks fall into the areas of safety and efficiency.

Dryer exhaust vent installations constructed of vinyl or other soft tubing are inherently unsafe and inefficient because the flexible tubing lacks the intrinsic physical support of a rigid metal system and is a poor conductor of the heated, moisture and lint laden, dryer exhaust. The intrinsic flexibility of the soft tubing types allow for excessive bending and kinking that can cause significant airflow restrictions or blockages. This, is turn, allows for the unsafe build-up of lint, exhaust heat, and toxic fumes. At minimum, this condition lowers the efficiency of the dryer over time. At worst, it precipitates the numerous fires (between 11,000 to 14,000 by consumer protection group estimates) started by improper venting of home dryers each year. Even if the flexible tubing is routed with the proper consideration to avoid kinking or blockages, the tubing itself collects significant amounts of lint on its internal surface when combined with the water vapor content of the dryer exhaust air.

An additional safety concern is the materials used in these flexible tubing products. The vinyl tubing, by its nature, is combustible and the foil tubing is an inadequate construction of a thin, lightweight aluminum covering over a spring wound with heavy paper. Thereby, not only would either type of soft tubing fail to contain a conduit fire should one start but both types would offer an additional combustion source if the overheated lint buildup should ignite.

As mentioned above, efficiency of the dryer's venting system coincides with its safety considerations. The use of flexible tubing as well as the typical industry standard round pipe can limit the dryer's efficiency. The limitations fall generally in the area of the physical installation. Both the flexible tubing and the standard round pipe have space and placement considerations for the installer. The tubing and round pipe both have to be routed to accommodate their diameter and the radius turns necessary to complete the installation. This translates into the inability to place the dryer in close proximately to the wall. There must be a standoff area allowed for the tubing or pipe to the turned out away from the back of the dryer and a corresponding space accommodation where the vent turns into the wall. Certain installations are non-critical in this respect, locating a dryer in a wide open, basement of a single family home, for example. However, quite often space is at a premium for the installation of today's modern appliances. Dryers are often paired with washers in cramped first floor apartment closets or shoehorned into small pantry spaces. Even the wide open basements of a single family homes can no longer afford to waste space by placing a dryer well away from a back or side wall. Efficiency also is lost in the luxury of a dryer vent installation that uses great amounts of free space. The dryer should have the shortest, most direct route to the outside wall vent. This minimizes airflow losses to lint buildup and reduces the chance of occurrence of vent blockages.

Since the long term build up of lint particulate is of critical concern, it should also be noted that the typically flexible tubing installation is in one long singular piece that does not generally facilitate or encourage regular disassembly and cleaning by the consumer. This again causes concern as a fire hazard. This non-accessible, permanent type of installation also plagues the other typical rigid type of dryer vent conduits available today. The consumer is not predisposed to effect cleaning of the dryer vent after it is installed and enclosed.

Therefore, it is the design intention of the present invention to overcoming these shortcomings. The low profile dryer vent exhaust system provides a compact and efficient short route to the outside vent by utilizing a flattened profile for its exhaust conduit. This allows for a rigid, substantial ductwork system that turns tight and has minimal radii. A unique feature of the system provides the homeowner with access ports for periodic cleaning, inspection, and removal of lint buildup. The rigid metal construction eliminates the problems with conduit combustibility and significantly lowers the rate of lint build up.

SUMMARY OF THE INVENTION

It is a first object of the present invention to provide a unique feature to a dryer exhaust system that allows the homeowner access to the internal areas of the exhaust conduit for the periodic removal of built up dryer lint for safety in fire prevention and for energy savings in maintaining peak dryer efficiency.

It is a second object of the present invention to provide a low profile rigid dryer vent exhaust system that allows for a close fit placement of a clothes dryer to a wall.

According to a first aspect of the present invention a low profile exhaust vent system is provided. The system is rigidly connected in a generally permanent configuration providing strength and security for the dryer vent system to safely pass large quantities of hot damp exhaust air to an outside vent outlet. Typical dryer vent installations are prone to the build up of, and ultimate blockage by, the large quantities of lint ambient in the exhaust air. At minimum, there is a gradual but substantial reduction in the drying efficiency of the appliance. More importantly however, there is a serious risk of fire when the lint builds to the point of blockage. These blockages may occur simply on their own or be additionally precipitated by a poor vent installation through the use of flexible tubing. When the exhaust vent becomes blocked the combustible nature of the lint creates a fire hazard.

The present invention is designed to overcome the typical fire danger caused by lint buildup and vent blockage inherent to all dryer exhaust vent conduit systems. This dryer exhaust vent system is constructed of rigid interlocking metal conduit sections. The rigid construction prevents the creation of tight bend kinking or conduit crushing inherent with common flexible systems. Certain sections of the present invention contain sliding panels to allow the homeowner access to the inside of the conduit at various locations in the ductwork. These movable panel openings allow the insertion of a vacuum source to remove the lint buildup. A typical home vacuum with an extension hose and a crevice tool will provide the homeowner with the ability to perform periodic lint cleanings of the dryer exhaust vent system thereby ensuring continued safe and efficient operation of the dryer.

According to a second aspect of the present invention a low profile exhaust vent system is provided. The system mechanically connects a typical, commercially available clothes dryer to an outside vent located in the wall structure of the home. The dryer vent system utilizes a flat rigid metal conduit with a generally rectangular cross-sectional area. This vent system with its "flattened" cross-sectional area allows the dryer a much closer physical placement to the wall behind the dryer. The vent connection is more compact and efficient. This is especially ideal in close quarter situations as in apartment installs where the dryer may be located in a small closet or alcove.

An additional unique feature is incorporated into all the low profile dryer exhaust vent system members that have a round smooth connection end. Certain system conduit members by necessity must interconnect with round pipe connections, i.e., the dryer and the outside wall outlet connector. Standard industry connections of this type do not hold together without additional means to secure them, i.e., duct tape and/or screws and/or clamps. All of these additional means to secure the round pipefittings have drawbacks. The duct tape has a limited life and loosens with age and the inherent moisture conditions of the dryer duct. Screws protruding fully through both connection pieces into the airflow are additional lint collection points, and clamps can crush the inner as well as outer pipe and still make a loose, unsecured connection.

Certain members of the present invention are formed to interconnect with round vent pipe fittings to overcome these connection drawbacks by utilizing a series of dimples about the ends of the smooth round pipe connection. These dimples protrude inward into the inner diameter of the opening and provide a secure and tight fit to the opposing connector. The dimples, by the nature of being punched slightly through the present invention member's sheet metal in a downward manner provide a sharp gripping edge to the opposing pipe fitting, keeping the connection tight. The dimples do not pierce through the inner connector and thereby do not become lint collectors, and there is no need for duct tape or clamps.

The present invention also embodies a low profile one piece connection fitting for locating a dryer close to a back wall when the outside wall vent connector is within very close proximity to the dryer outlet connector. In typical installations this situation causes the dryer to be placed out away from the wall. This is because the radius of the dryer outlet connection and the radius of the wall vent connection, as well as the diameter of the round pipe connector must be all be accounted for in the vent pipe connection. The present invention embodiment is low profile and adjustable and can provide a very close dryer placement the wall in a quick, easy, and safe one-piece installation.

The present invention also has an embodiment for applications in new construction and major remodeling. Standard width dwelling walls are generally constructed around the industry standard 2×4 piece of construction lumber. The standard 2×4 measures in practical terms much closer to 3 and ¾ inches in width. This measurement forms the width of the open space within the constructed wall. In many of the various close fit washer/dryer installation situations described above, the building contractor is forced to route the dryer exhaust conduit vertically, in elevation, inside a standard width wall to another elevation. Beyond the present invention there exists no currently available method to cleanly route the dryer exhaust system vertically inside the narrow wall space to mate with an outside vent outlet placed at a different elevation. This means that often dryers are vented into open crawl spaces, or wall spaces, or that standard round conduit is employed and crushed to fit. Venting to an open space within, or under, or above the living space or the use of crushed, mangled vent pipe in the wall causes the undesirable and unsafe conditions of high concentrations of water vapor, lint and possibly toxic fumes within the home. If dryer placement within the dwelling is such that vent conduit routing must run vertically, in elevation, inside a standard wall, the low profile dryer exhaust system fits cleanly and easily into a standard width wall. An adapter is one of the preferred embodiments that allow this system to be routed through interior walls.

These and other objects, aspects, and advantages of the present invention will become apparent upon reading the following detailed description in combination with the accompanying drawings.

DETAILED DESCRIPTION OF THE PREFERRED EMBODIMENT OF THE INVENTION

Figure 1:
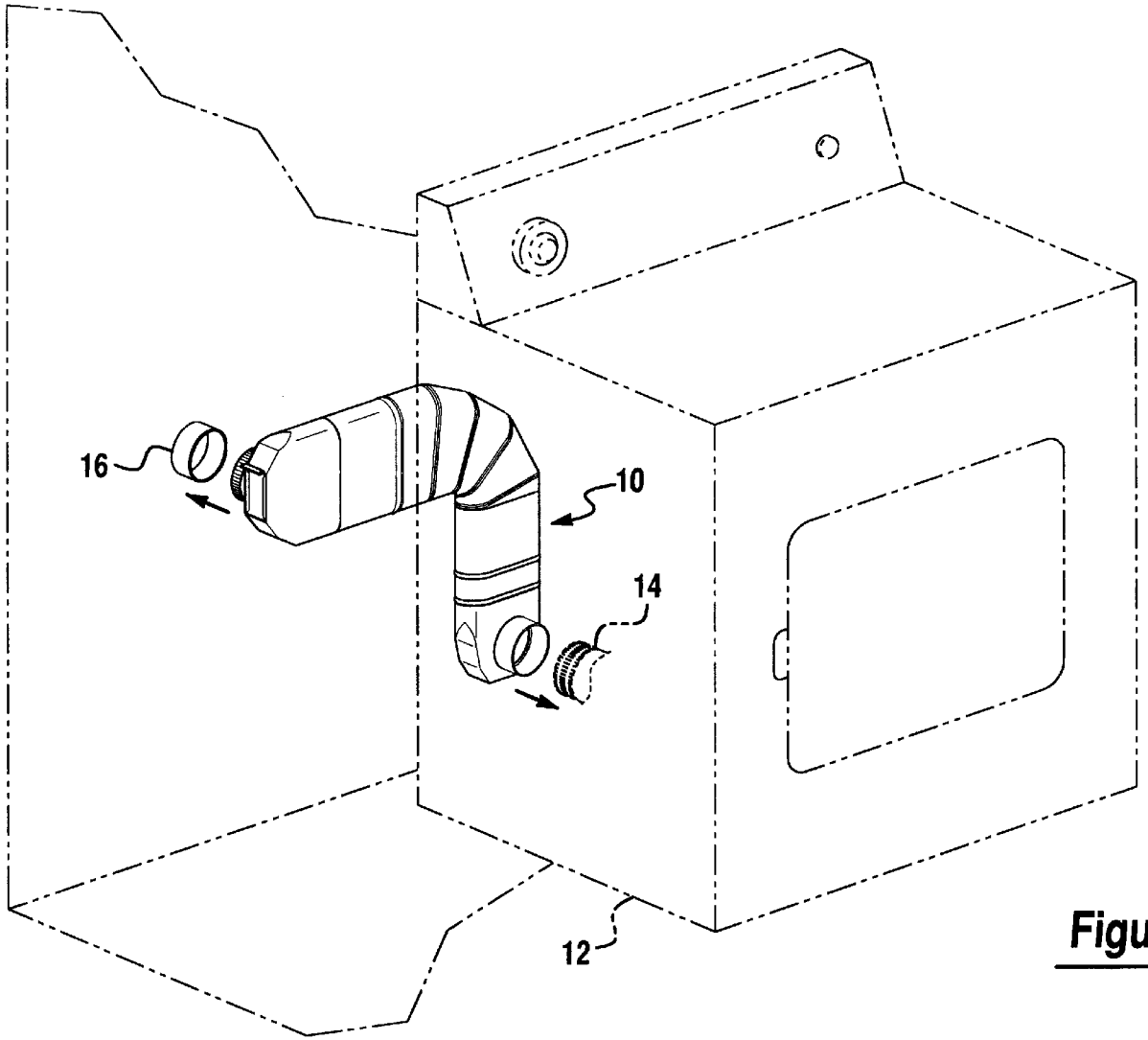
FIG. 1 is a perspective view of a typical commercially available clothes dryer 12 incorporating a low profile dryer vent exhaust system 10 that is made in accordance with the teachings of the preferred embodiment of the invention, to attach the dryer's exhaust outlet 14 to a outside outlet vent 16 in the wall.

Referring now to FIG. 1, there is shown a dryer exhaust vent system 10 that is made in accordance with the teachings of the preferred embodiment of the invention and which is operatively attached to a typical commercially available clothes dryer 12. The dryer vent exhaust system 10, attaches to the typical commercial dryer's exhaust outlet 14 and to an outside outlet vent 16 located in the wall of the home. It should be realized that the system 10 may be used in a variety of connection configurations based on the physical location of the dryer and its exhaust outlet 14 in relation to the outside outlet vent 16 of the dwelling. The present invention is not limited to only the physical representation as shown in FIG. 1 and 2.

Figure 2:
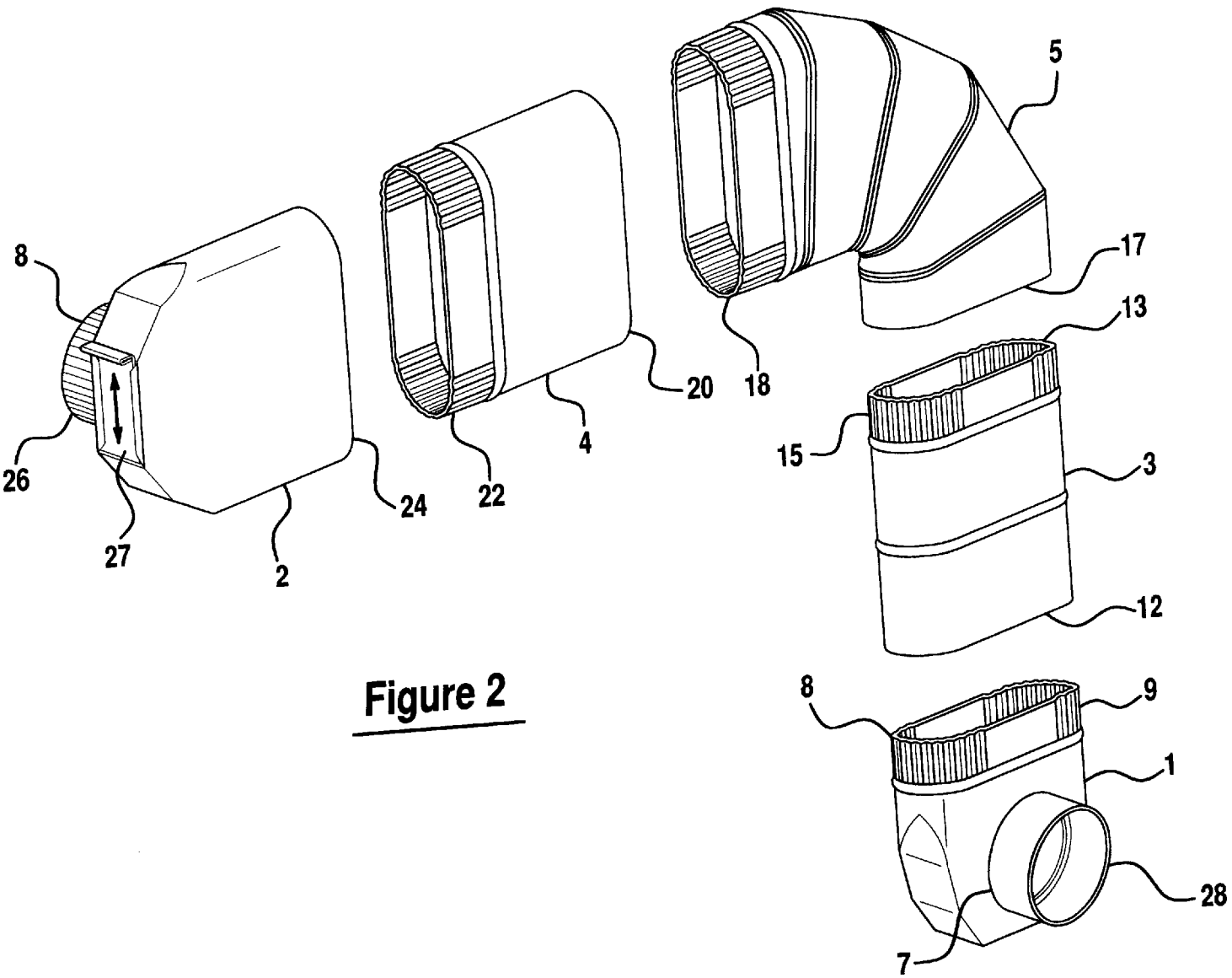
FIG. 2 is an unassembled perspective view of a low profile dryer exhaust vent system.

FIG. 2 is an unassembled perspective view of a dryer exhaust vent showing the sectional parts of the preferred embodiment of the present invention.

Dryer connection section member 1 is formed from sheet metal in a manner to produce a generally rectangular cross-sectional conduit with an open and a closed end. The closed end of the dryer connection section member 1 has a round standard size vent pipe connector 7 attached to its flat side surface. The pipe portion is open to the internal cavity of the dryer connection section member 1 thereby creating a low profile 90-degree elbow. Pipe portion 7 maintains its circumference at its end 28 and serves as the female portion of the press-fit joint with a typical commercially available dryer discharge outlet (FIG. 1, number 14). The open end 8 has an industry standard crimp and reduction area 9 on its outer end. This crimp and reduction area 9 serves to reduce the circumference of the member and allow it to serve as the male portion of the press-fit joint with the straight standing vent section member 3.

The straight standing vent conduit section member 3 is formed from sheet metal in the same generally rectangular cross-sectional area as the dryer connection fitting 1 and all other low profile section members of this system. Section member 3 has both ends open. End area 12 has no additional forming performed on it and serves as the female side of the press-fit connection with the dryer connection section member 1. The opposite end 13 has a crimp and reduction area 15 that serves as the male side of the press-fit connection with the flat elbow conduit section member 5.

Section member 3, as the preferred embodiment, is to be manufactured in varying lengths as alternate embodiments allowing for variations in the requirements of the installation at the site. These variants are to be considered as alternate length extension pieces of the system.

As such, system section member 4 of FIG. 2 is identical to the above-described system section member 3. Excepting that in this embodiment, the crimp and reduction end 22 is used as the male side of the press-fit joint with system section member 2 and that the smooth end 20 is used as the female side of the press-fit joint with system section member 5.

System section member 5 is also formed from sheet metal in the same generally rectangular cross-sectional area as the other members of the invention. It is also constructed, as section members 3 and 4 above, with a male and female end. The crimp and reduction formed end 18 serves as the male side of the press-fit connection with section member 4 and the smooth end 17 serves as the female side of the press-fit connection with section member 3. As noted in FIG. 2, this section member is arcuately curved about the wide longitudinal axis to form a flat 90-degree elbow. FIG. 2 depicts section member 5 constructed of 5 arcing sections, this is not a limiting embodiment but is merely a graphic representation in reflection of current manufacturing limitations in sheet metal construction.

Outside wall connection section member 2 is also formed from sheet metal in a manner to produce the same generally rectangular cross-sectional conduit with an open and a closed end. The closed end of the outside wall connection section member 2 has a round pipe connector portion 8 attached to its flat side surface. The pipe portion 8 is open to the internal cavity of the outside wall connection section member 2 thereby creating a low profile 90-degree elbow. The pipe portion 8 has a crimp and reduction area on its end 26 that serves as the male portion of the press-fit joint with a typical outside wall vent outlet (FIG. 1, number 16) in the dwelling. The open end 24 has no other forming performed on it and it serves as the female side of the press-fit joint with the system section member 4.

Section member 2 may also be used in physical circumstances in which it is necessary to connect the low profile dryer vent system to standard round pipe conduit prior to reaching the outside wall vent outlet. As such, section member 2 functions exactly the same, but the crimp and reduction area 26 will be used as the male side of a press-fit connection with a non-system round conduit pipe as opposed to connecting directly to the outside wall vent outlet (FIG. 1, number 16).

Section member 2 also embodies a sliding cover plate 27 on its closed end. This cover plate 27 is normally maintained in the closed position allowing for the flow of dryer air to be directed out of the outside wall connector's pipe section 8 and into the outside wall vent outlet of the dwelling (FIG. 1, number 16). The cover plate 27 is moved into the open position by the homeowner to effect periodic lint removal and system inspection. The opening provided by placing the cover plate 27 in the open position allows the homeowner to insert a vacuum source into the system conduit for lint removal. Once any lint buildup is removed, the homeowner may make an internal visual inspection of the system conduit though the cover plate 27 access. It is understood that a visual inspection of the system may be limited by the physical placement and location of the system and the dryer within the dwelling.

Figure 3:
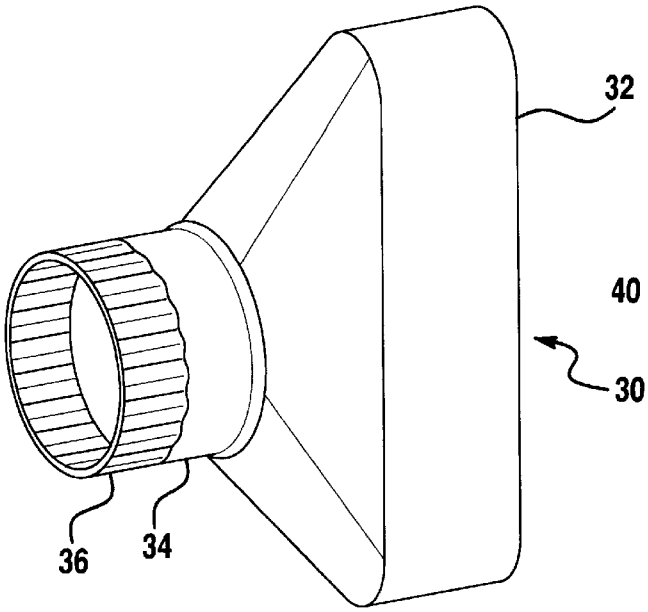
FIG. 3 is an additional embodiment of a singular member of the low profile dryer vent exhaust system used to connect the low profile conduit to either the outside wall outlet connector or a typical round pipe as necessary.

FIG. 3 depicts an alternate embodiment of the system end connector which mates with either the outside wall vent outlet (FIG. 1, number 16) of the dwelling or to some other round pipe conduit. End connector 30 is formed of sheet metal of the same generally rectangular cross-sectional area as the other section pieces in this system. Its open end 32 is smooth formed and serves as the female side of a press-fit connection with other system section members, either 1, 3, 4, or 5. The other end of end connector 30 has a pipe section 34 attached for mating with the outside wall vent outlet (FIG. 1, number 16) of the dwelling or to some other round pipe conduit. The pipe end 34 has a crimp and reduction section 36 to serve as the male end of the press-fit connection.

Figure 4:
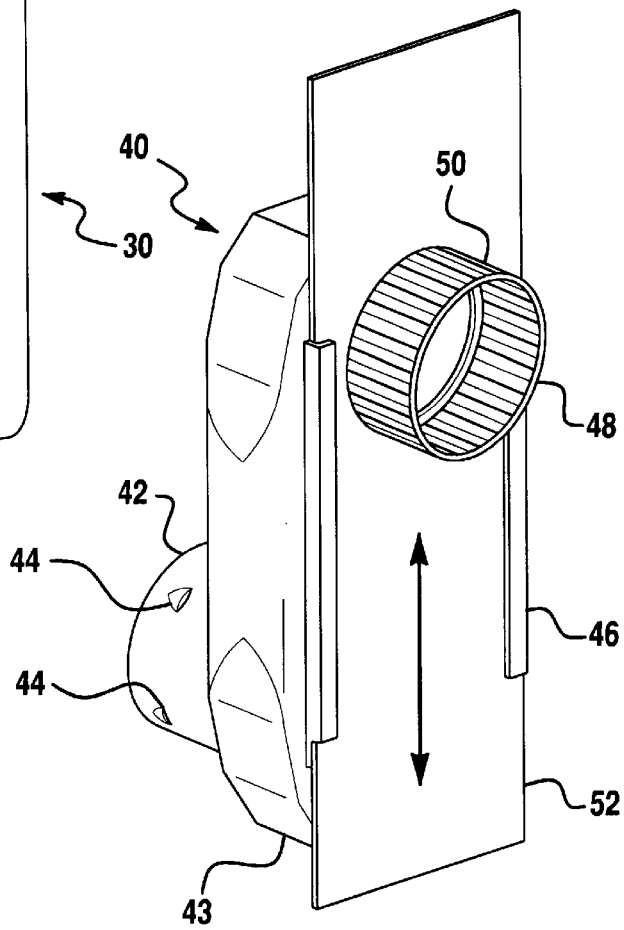
FIG. 4 is an additional embodiment of a singular adjustable member of the low profile dryer vent exhaust system used by itself to connect a typical dryer to the outside wall outlet connector when they within close radial proximity to each other in the area directly behind the dryer.

FIG. 4 is the preferred embodiment as a singular all-inclusive one-piece member 40 of low profile dryer vent system for certain limited situations. This member 40 is aptly referred to as the "0 to 7 sliding wall adapter". If the dryer (FIG. 1, number 12) is to be placed with its back to the wall in which the wall vent outlet in the dwelling (FIG. 1, number 16) is located within 0 to 7 inches center to center radially from the dryer discharge outlet (FIG. 1, number 14), then member 40 will adjust to fit that distance as a singular unit. The "0 to 7 sliding wall adapter" 40 is formed from sheet metal with the main body 43 having the same generally rectangular cross-sectional area as the other members of the low profile dryer vent exhaust system. The main body 43 is generally a closed-ended rectangular low profile box. The front face of the main body 43 has the dryer inlet connector pipe 42 attached at its lower end. The dryer inlet connector pipe 42 is open to the interior of the main body 43 to allow the influx of airflow from the dryer. The dryer inlet connector pipe 42 of the "0 to 7 sliding wall adapter" 40 is fit onto the dryer outlet discharge pipe (FIG. 1, number 14). A series of dimples 44 are stamped into the dryer inlet connector pipe 42 that allow it to securely grip the dryer outlet discharge pipe (FIG. 1, number 14). These dimples 44 protrude inward into the inner diameter of the opening and offer small sharp inward oriented edges to provide a secure and tight fit to the opposing connector. Each dimple is made by making a small circumferential cut slightly back from the open end of the pipe section 42 and pressing slightly inward on the side of the cut closest to the outer end.

In a non-limiting embodiment, the dryer inlet connector pipe 42 is attached to the main body 43 in such a manner as to allow it to rotate. This allows the "0 to 7 sliding wall adapter" 40 to rotate about the dryer outlet discharge pipe (FIG. 1, number 14), as required, to align with the wall vent outlet (FIG. 1, number 16). The main body 43 of the "0 to 7 sliding wall adapter" 40 has a sliding panel 52 as its rear face. The back of the main body 43 is open to the inner surface of the sliding panel 52. The main body 43 and has small lips of sheet metal 46 rolled about the lateral edges of the sliding panel 52 to secure it to the main body 43 yet allow selective positioning of the sliding panel 52 in the vertical plane. The sliding panel 52 has the outside wall outlet connector fitting 48 attached roughly one-third from the upper end. The outside wall vent connector fitting 48 is open, through the sliding panel 52, to the interior of the main body 43. This allows the dryer airflow to exit the sliding adapter main body 43 into the outside wall vent outlet (FIG. 1, number 16) in the dwelling.

The wall outlet connector fitting 48 has a crimp and reduction area on its end 50 that serves as the male portion of the press-fit joint with the outside wall vent outlet (FIG. 1, number 16) in the dwelling.

Figure 5:
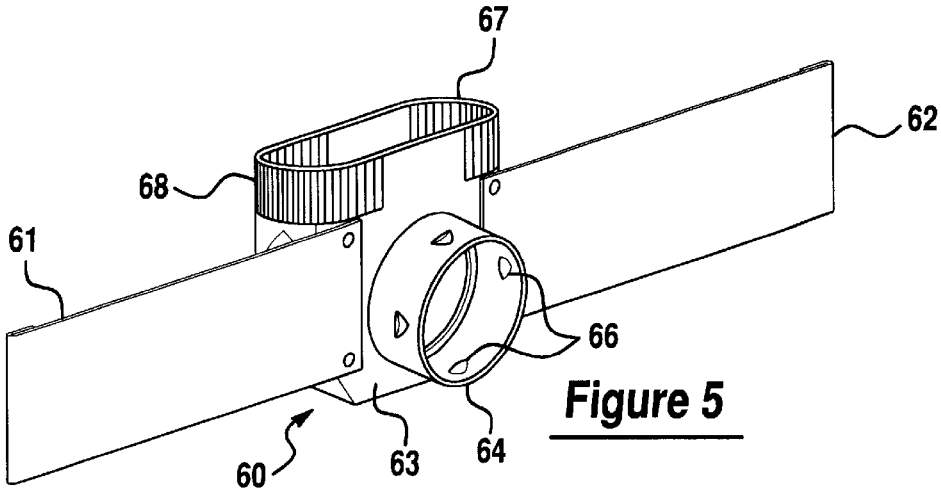
FIG. 5 is an additional embodiment of a singular member of the low profile dryer vent exhaust system used in new home construction or major remodeling to route the low profile dryer vent system vertically, in elevation, through the inside of a standard width wall.

FIG. 5 depicts a preferred embodiment of a system member used in new home construction or in major remodeling to route the low profile dryer vent system vertically, in elevation, inside a standard width wall. The embodiment, wall connector 60, is in essence physically the same as the above defined dryer connection fitting (FIG. 2, number 1) with the additional of two flat horizontal sheet metal elements 61 & 62. Elements 61 & 62 are of equal length and project horizontally from the front face of the main body 63 to the right and left sides. Horizontal elements 61 & 62 are long enough to exceed the span of standard width spacing of 2×4-stud placement in typical home building construction. Similar to dryer connector 1, wall connector 60 has an inlet pipe 64 attached to its front face open to the internal cavity of the main body 63 allowing the passage of dryer exhaust airflow. Once the wall layment is erected, only the inlet pipe 64 will be exposed into the room. The inlet pipe 64 has dimples 66 pressed into its circumference to form a tight connection with the one of the other system members of the low profile dryer exhaust vent system external to the wall.

When installed, the main body 63 of the wall connector 60 is placed within the open wall cavity with the inlet pipe 64 facing outward to the installer. The horizontal elements 61 & 62 lay across the left and right wall studs and are secured to them. This supports the wall connector 60 at the desired vertical height within the wall structure. The open end 67 of the wall connector 60 may be oriented to either the top or the bottom, depending on the installation requirements. The open end 67 has a crimp and reduction section 68 to serve as the male side of the press-fit connection with the other system elements the installer chooses to use to complete the in-wall low profile exhaust vent system. Other system members described in this specification are utilized to complete the internal wall conduit run to its termination at an appropriate outside vent point.

Figure 6:
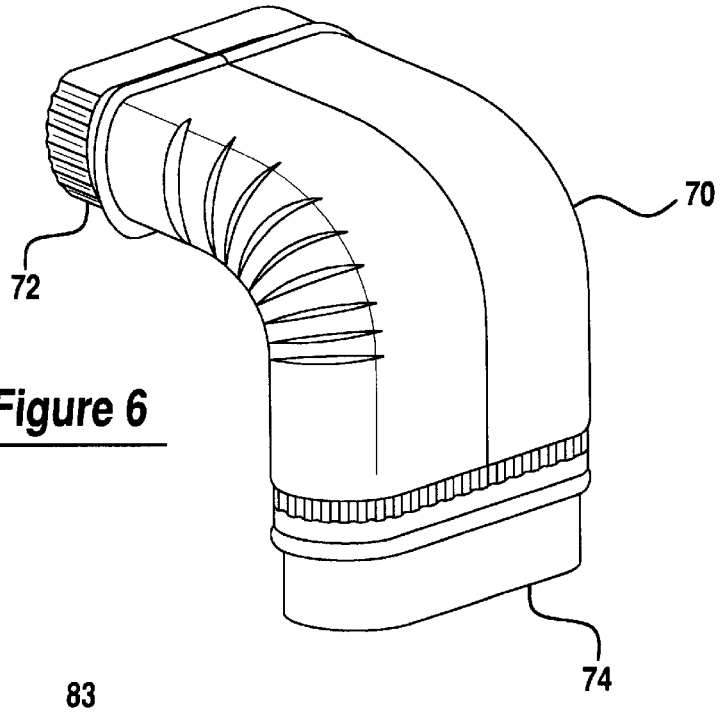
FIG. 6 is an additional embodiment of a singular member of the low profile dryer vent exhaust system used to route conduit around the side of the dryer forward, or around a wall corner, or in some other manner in which an elbow with a radius formed about the narrow side of the low profile cross-section is necessary.

FIG. 6 depicts an additional embodiment of a singular member of the low profile dryer vent exhaust system, the corner elbow 70. The corner elbow 70 is also formed from sheet metal in the same generally rectangular cross-sectional area as the other members of the invention. It is also constructed, as the other section members described in this specification, with a male and female end. The crimp and reduction formed end 72 serves as the male side of the press-fit connection with other section members and the smooth end 74 serves as the female side of the press-fit connection with other section members. The corner elbow 70 is arcuately curved about the narrow longitudinal axis to form a wide 90-degree elbow.

Figure 7:
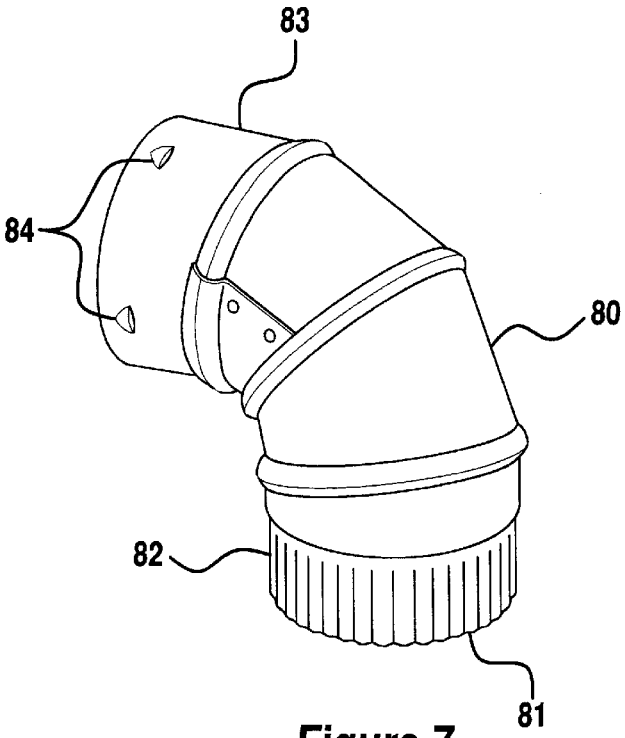
FIG. 7 is an additional embodiment of a singular member of the low profile dryer vent exhaust system used when connection with round pipe is required, or in other circumstances requiring round pipe conduit deflection in some angle between 90 and 180 degrees, shows gripping dimples on smooth bore female end.
Figure 8:
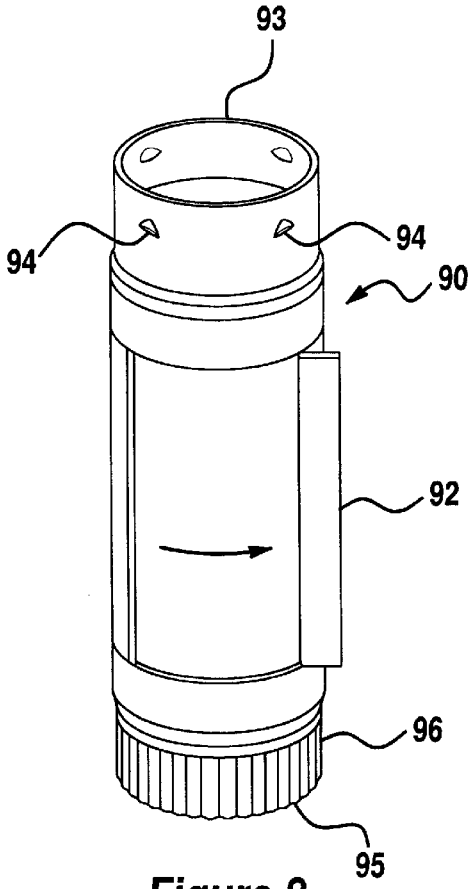
FIG. 8 is an additional embodiment of a singular member of the low profile dryer vent exhaust system used when a round pipe section is required, shows movable slide panel to allow cleaning access and gripping dimples on smooth bore female end.

FIGS. 7 and 8 depict round pipe members of this system for use with interconnections to existing round pipe or where other circumstances warrant their use. FIG. 7 is an additional embodiment of a singular member of the low profile dryer vent exhaust system used when connection with round pipe is required. Round elbow 80 has, by construction, three joints that allow rotation and flexibility in setting a desired angular deflection between 90 and 180 degrees. Round elbow 80 has a male and female end. The male end 81 has a crimp and reduction area 82 and the female end 83 has the above-described dimples 84.

FIG. 8 is an additional embodiment of a singular member of the low profile dryer vent exhaust system also used when a round pipe section is required. This straight round pipe section 90 embodiment incorporates a sliding panel 92, to allow cleaning access. The sliding panel 92 runs along the majority of longitudinal axis providing an opening of approximately one third to one half of the pipe section circumference. Straight round pipe section 90 has a male and female end. The male end 95 has a crimp and reduction area 96 and the female end 93 has the above-described dimples 94.

It should be understood that the invention is not limited to the exact embodiment or construction which has been illustrated and described but that various changes may be made without departing from the spirit and the scope of the invention.

What is claimed is:

1. A dryer exhaust vent connector comprising a member which has a selectively movable panel which moves from a first closed position to a second open position thereby allowing the exhaust vent connector to be selectively cleaned, said member having a vent pipe connector and a crimp and reduction connector which cooperatively allow said member to operatively connect a dryer to an outlet vent.

2. The vent connector of claim 1 wherein said member is cylindrical.

3. A low profile dryer vent exhaust system which is adapted to selectively attach an exhaust outlet of a dryer to an outlet vent, said exhaust system comprising:

a first 90 degree low profile elbow having a vent pipe connector and a crimp and reduction portion;

a second member having a generally rectangular cross sectional area and having a first end which may be selectively inserted into said crimp and reduction portion of said first 90 degree low profile elbow and a second crimp and reduction end;

a flat 90 degree elbow member having a first end which may be selectively inserted into said crimp and reduction end of said second member and a second crimp and reduction end;

a fourth member which is substantially similar to said second member and having a first end which may be selectively inserted into said crimp and reduction end of said flat 90 degree elbow member and having a second crimp and reduction end; and a fifth outside wall connection member having an outside wall connector and a second end which may be selectively inserted into said crimp and reduction end of said fourth member, said fifth outside wall connection member having a slidable door which allows said interior of said first 90 degree low profile elbow, said second member, said flat 90 degree elbow member, said fourth member, and said fifth outside wall connector member to be cleaned.

4. A dryer vent member having a dryer inlet connector pipe with a plurality of dimples, said dryer vent member further having a main body to which said connector pipe is rotatably attached, said main body further having a panel which is slidably coupled to said main body and including an outlet connector which is disposed upon said panel.

5. A dryer vent connector having a hollow member which has a generally rectangular cross sectional area and having a vent pipe connector and a crimp and reduction area, said dryer connector further including first and second planar members which are attached to opposite sides of said hollow member and which cooperatively exceed the span of a 2×4 stud.

* * * * *